US006321847B1

(12) United States Patent
Brown

(10) Patent No.: US 6,321,847 B1
(45) Date of Patent: Nov. 27, 2001

(54) DOWNHOLE PRESSURE ACTIVATED DEVICE AND A METHOD

(75) Inventor: Irvine Cardno Brown, Aberdeen (GB)

(73) Assignee: Petroleum Engineering Services Limited, Aberdeen (GB)

( * ) Notice: Subject to any disclaimer, the term of this patent is extended or adjusted under 35 U.S.C. 154(b) by 0 days.

(21) Appl. No.: 09/424,675

(22) PCT Filed: May 27, 1998

(86) PCT No.: PCT/GB98/01553

§ 371 Date: Nov. 29, 1999

§ 102(e) Date: Nov. 29, 1999

(87) PCT Pub. No.: WO98/54439

PCT Pub. Date: Dec. 3, 1998

(30) Foreign Application Priority Data

May 27, 1997 (GB) ..... 9710746

(51) Int. Cl.[7] ..... E21B 23/04; E21B 34/08; E21B 34/10

(52) U.S. Cl. ..... 166/374; 166/212; 166/319; 166/382; 166/383

(58) Field of Search ..... 166/120, 212, 166/319, 321, 323, 374, 382, 383

(56) References Cited

U.S. PATENT DOCUMENTS

| | | | | |
|---|---|---|---|---|
| 3,964,305 | * | 6/1976 | Wray et al. | 166/321 X |
| 4,113,012 | * | 9/1978 | Evans et al. | 166/321 X |
| 4,285,400 | * | 8/1981 | Mullins, II | 166/120 X |
| 4,421,174 | | 12/1983 | McStravick et al. | 166/374 |
| 4,444,268 | | 4/1984 | Barrington | 166/373 |
| 4,448,254 | | 5/1984 | Barrington | 166/373 |
| 4,595,060 | * | 6/1986 | Beck | 166/373 |
| 4,664,196 | | 5/1987 | Manke | 166/378 |
| 4,665,991 | | 5/1987 | Manke | 166/373 |
| 4,766,960 | * | 8/1988 | Williamson, Jr. | 166/321 |
| 4,791,991 | * | 12/1988 | Morris et al. | 166/319 |
| 5,050,681 | * | 9/1991 | Skinner | 166/374 |
| 5,209,303 | | 5/1993 | Barrington | 166/374 |
| 5,564,501 | * | 10/1996 | Strattan et al. | 166/321 X |

FOREIGN PATENT DOCUMENTS 2 289 488 11/1995 (GB) .

* cited by examiner

*Primary Examiner*—George Suchfield
(74) *Attorney, Agent, or Firm*—Allan Ratner

(57) ABSTRACT

A downhole pressure activated device and a method of operating a tool comprises a chamber which has a fluid port for communication between the chamber and downhole fluid located outwith the device. The fluid port preferably comprises a check valve and a fluid flow restrictor connected in parallel, where preferably, the check valve permits fluid flow into the chamber and substantially prevents reverse flow. The chamber is provided with a pressure transmission means by which a pressure in the chamber greater than that in the downhole fluid is capable of being applied to a tool to be operated by the device.

30 Claims, 5 Drawing Sheets

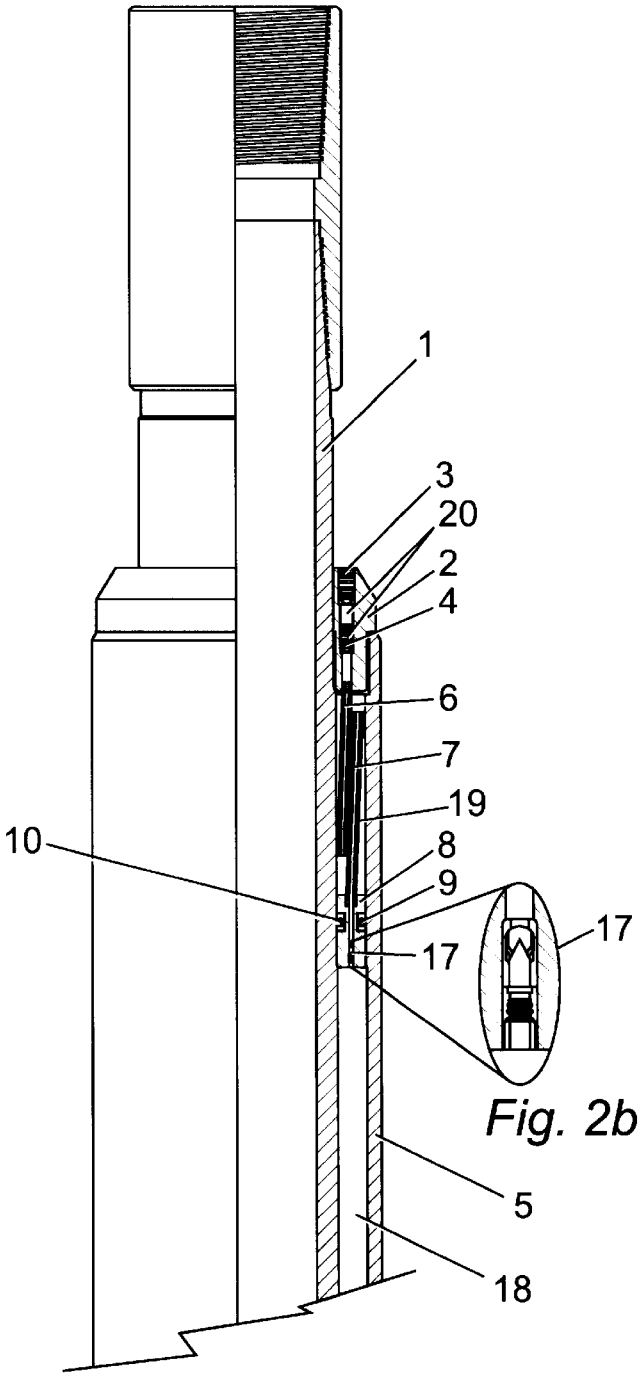
Fig. 2b
Fig. 2a
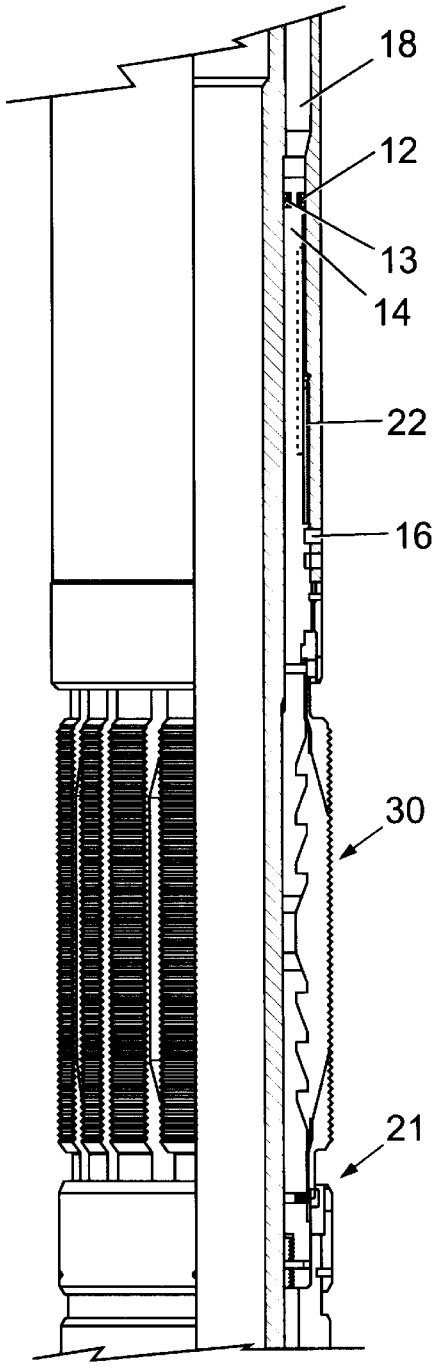
Fig. 2c

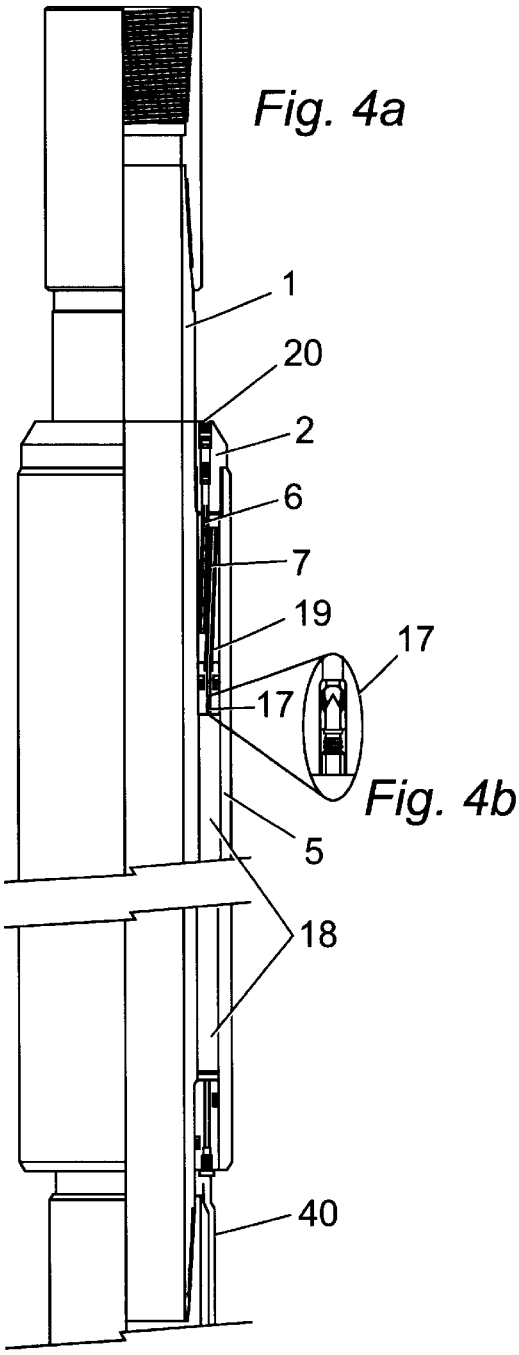
Fig. 4a
Fig. 4b
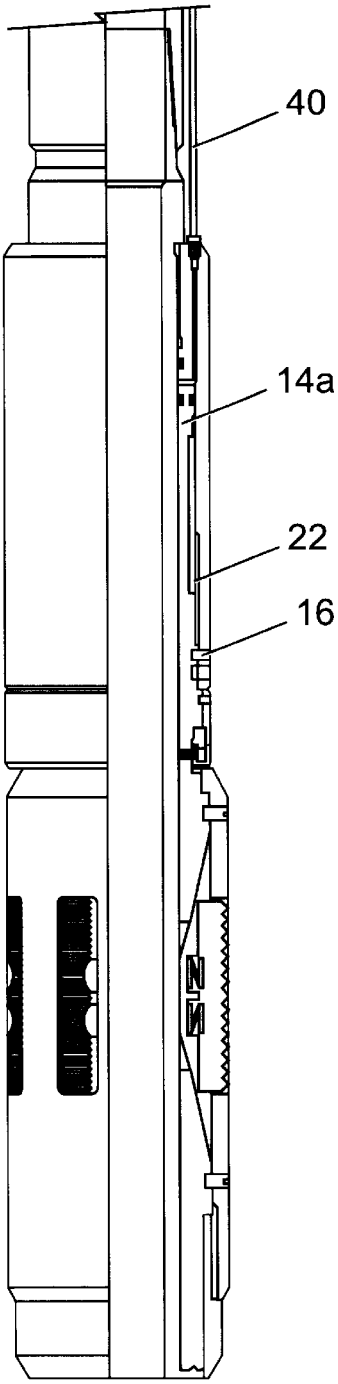
Fig. 4c

DOWNHOLE PRESSURE ACTIVATED DEVICE AND A METHOD

BACKGROUND OF THE INVENTION

This invention relates to a pressure activated device and a method for use downhole in oil wells and the like. The device and method can be used to set devices such as packers and hangers which must be mechanically engaged with tubing.

Most setting mechanisms previously used have relied on elastomeric seals to prevent leaks between the tubing and the annulus, but the elastomers degrade with time and this arrangement gives poor reliability in completion strings.

Setting devices have previously been used in which sealing between the tubing and the annulus does not rely on elastomeric seals. Such devices use an electronic module and an explosive charge held within an atmospheric chamber. The electronic module monitors pressure pulse signals applied to the drill or completion string and in response to the correct code ignites the explosive charge to generate a high pressure gas. The gas in turn is used to apply hydraulic pressure to the tool to be set.

This type of setting tool is very complicated and has a number of disadvantages. Atmospheric chambers in the tool are inherently unreliable, and typically dependent upon the elastomeric seals, and in the event of leakage into the chamber the tool becomes inoperable. The electronic module is subject to temperature limitations, especially at depth. Since the explosive charge is housed within the atmospheric chamber, no pressure differential will be generated at the setting piston until the hydrostatic pressure outside the setting tool has been overcome by the charge pressure, which limits the setting load available and puts a depth limit on the setting tool.

BRIEF SUMMARY OF THE INVENTION

According to a first aspect of the present invention, a downhole pressure activated device comprises a chamber having a fluid port for communication between the chamber and downhole fluid located outwith the device, the fluid port comprising a fluid flow control mechanism which permits fluid flow into the chamber and substantially prevents reverse flow, and the chamber being provided with a pressure transmission means by which a pressure in the chamber greater than that in the downhole fluid is capable of being applied to a tool to be operated by the device.

According to a second aspect of the present invention, there is provided a method of operating a tool downhole by applying pressure, the method comprising the steps of:

including in a string for insertion into a borehole a pressure activated device comprising a fluid chamber which communicates with downhole fluid located outwith the device in the borehole in a manner that allows substantially uninhibited flow of fluid into the chamber but substantially restricts flow of fluid out of the chamber, a pressure transmission means in fluid communication with the chamber and the pressure transmission means being connected to the tool operated by applying pressure;

inserting the string into the borehole;

increasing the pressure of fluid within the borehole so that a portion of the fluid flows from the borehole into the chamber;

reducing the pressure of the fluid in the borehole to generate a pressure differential between the fluid in the borehole and the fluid in the chamber;

whereby the pressure differential acts upon the pressure transmission means to operate the tool by applying pressure.

Preferably, the fluid flow control mechanism comprises a check valve and a fluid flow restrictor arranged in parallel, the check valve permitting fluid flow into the chamber and substantially preventing reverse flow.

Preferably, the chamber is a second chamber, and the device further comprises a first chamber, the first and second chambers being interconnected by the fluid port, and the first chamber having a fluid inlet which, in use, is open to the downhole fluid located outwith the device.

Typically, the pressure transmission means is a piston located within the second chamber that causes a mechanical force to be applied to the tool.

Preferably, the piston is provided with means permitting motion of the piston in a tool setting direction and preventing reverse motion.

Alternatively, the pressure transmission means may be a fluid outlet that transmits the pressure of the fluid to the tool.

In a preferred form of the invention, the device comprises an inner mandrel for connection in a borehole string, and an outer mandrel, the annular space between the inner and outer mandrels being divided by a seal ring to define said first and second chambers, the piston being a cylindrical member slidable between the inner and outer mandrels at one end of the device, and said inlet being provided at the opposite end of the device and including filter means.

The check valve may be within the seal ring and communicating with the first chamber via an inlet tube.

The means permitting one way motion may suitably be in the form of a C-shaped annular member interposed between the piston and the outer mandrel, the C-shaped member being provided on its opposite faces with circumferential threads or teeth engaging in matching formations in the pistons and the outer mandrel. Typically, the outwardly facing threads or teeth of the C-shaped mandrel will be relatively coarse and the inwardly facing ones relatively fine.

Typically, the piston is initially locked to the outer mandrel by means such as shear pins adapted to yield under a given applied load.

Preferably, the device is included in a completion string.

BRIEF DESCRIPTION OF THE DRAWINGS

Embodiments of the present invention will now be described, by way of example only, with reference to the accompanying drawings, in which:

FIG. 2(*b*) shows an exploded view of a check valve included in FIG. 2(*a*);

FIG. 2(*c*) shows the upper middle quarter of the device of FIG. 2(*a*);

FIG. 2(*d*) shows the lower middle quarter of the device of FIG. 2(*a*);

FIG. 2(*e*) shows the lower quarter of the device of FIG. 2(*a*);

FIG. 4(*a*) shows the upper half of a second form of the device combined with a hanger, in a half-sectional side view;

FIG. 4(*b*) shows an exploded view of a check valve included in FIG. 4(*a*); and FIG. 4(*c*) shows the lower half of the device of FIG. 4(*a*).

DETAILED DESCRIPTION OF THE INVENTION

Figure 1:
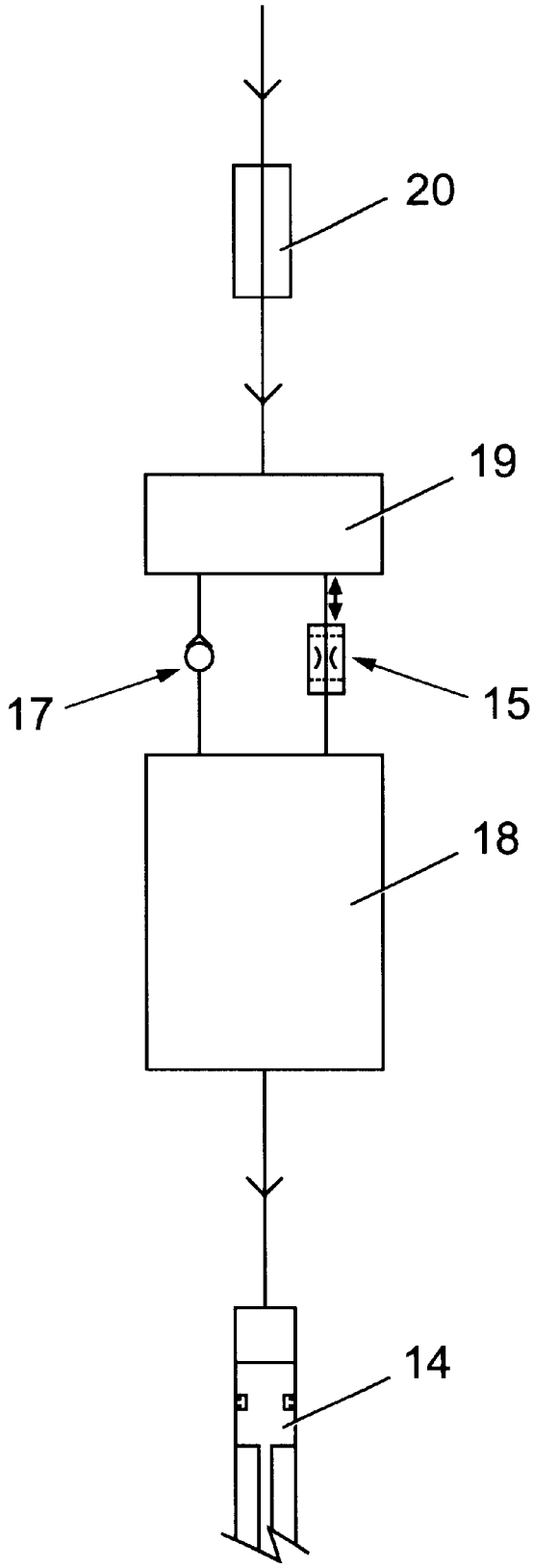
FIG. 1 is a system block diagram of a downhole pressure activated device in accordance with the invention.

Referring to FIG. 1, the device of the present invention has the purpose of selectively operating a piston 14 by means of which mechanical force may be applied to any desired mechanically-set downhole tool, the tool to be set not forming part of the present invention.

Figure 2D:
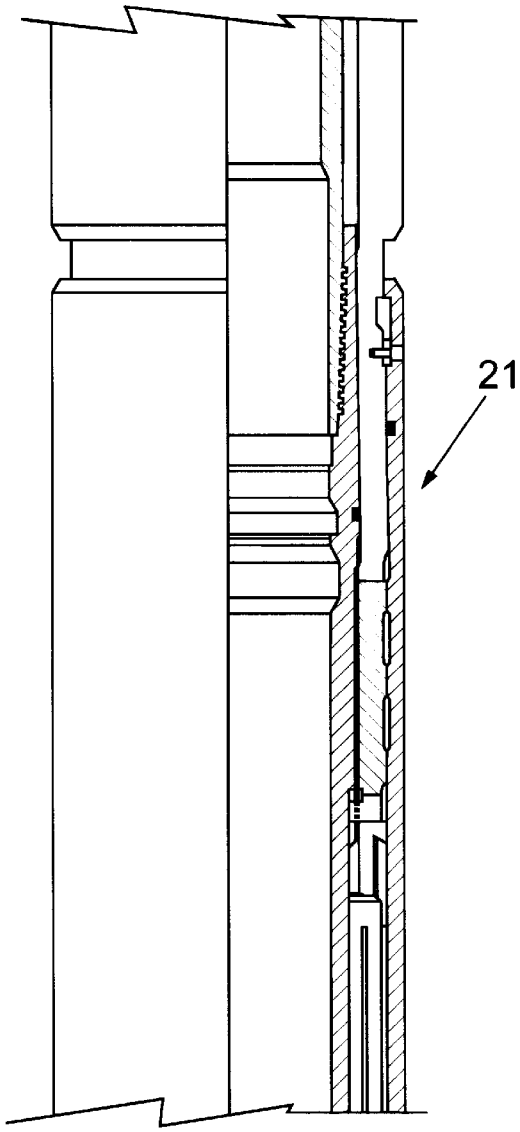
FIG. 2(*a*) shows the upper quarter of a first form of the device combined with a hanger, in a half-sectional side view.
Figure 2E:
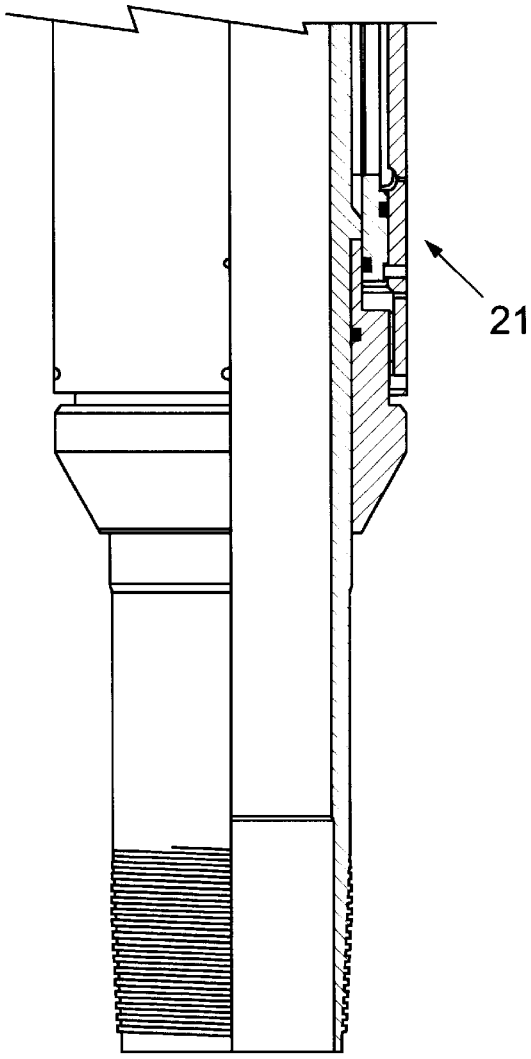

The piston 14 is actuated by hydraulic pressure from a reservoir 18 filled with compressible fluid which forms a second chamber. A first chamber or top up chamber 19 is connected to the reservoir 18 via a top up chamber outlet tube 7 as shown in FIG. 2(*a*), and a LEE (™) check valve 17 permitting flow from the top up chamber 19 to the reservoir 18, and in parallel by a two-way restrictor 15. The top up chamber 19 is in communication with the borehole annulus via a filter assembly 20.

Referring now to FIGS. 2(*a*), (*b*), (*c*), (*d*) and (*e*), the device includes an inner mandrel 1 having a through-bore and provided with the customary pin and box connections. An outer mandrel 5 concentric with the inner mandrel 1, in conjunction with an end cap 2 and a piston 14, defines an annular chamber which is partitioned by a concentric seal ring 8 to form the top up chamber 19 and the reservoir 18, these being sealed from each other by O-rings 9 and 10 carried by the seal ring 8. The seal ring 8 sits within shoulders formed on the outer 5 and inner 1 mandrels. The check valve 17 is positioned within the seal ring 8 and communicates with the top up chamber 19 via a top up chamber outlet tube 7. The two-way restrictor 15 is also positioned within the seal ring 8 at a position not seen in FIGS. 2(*a*), (*b*), (*c*), (*d*) or (*e*).

The top up chamber 19 communicates with the borehole annulus via a fluid inlet tube 6 and first and second stage filters 3 and 4 respectively which together form the filter assembly 20.

The fluid inlet tube 6, and the top up chamber outlet tube 7 are staggered radially and longitudinally, as shown in FIG. 2(*a*), and this arrangement promotes the advantage that fluid flowing into the top up chamber 19 displaces fluid originally located therein into the outlet tube 7, and thereafter into the oil reservoir, thus forming a debris trap.

The piston 14 is of annular form and, in this embodiment, is integral with the operating mechanism 30 of a hanger designated generally as 21. The piston 14 is provided with inner 13 and outer 12 T-seals bearing against the inner mandrel 1 and outer mandrel 5. The piston 14 is initially locked with respect to the outer mandrel 5 by one or more shear pins, one of which is seen at 16. After fracture of the shear pin 16, the piston 14 is restrained to downward motion, downwards as seen in FIG. 2(*c*), by means of a serrated C-ring 22 which will be described in greater detail below.

In use, the reservoir 18 and the top up chamber 19 are filled with a suitable fluid. The assembly of FIGS. 2(*a*) to (*e*) is preferably included in a completion string, but could also be included in a drill string, and is run to the desired position.

A significant feature of the invention is that in use the reservoir 18 is filled with a compressible fluid. It is preferred to use a compressible liquid such as silicon oil. Conveniently, the top up chamber 19 will be initially filled with the same fluid but it would be possible to use a different fluid.

The main function of the top up chamber 19 is to provide a clean compressible fluid which can be inserted into the reservoir 18, upon activation of the device, as will now be described.

When the device has been run to the desired position, pressure is applied to the well fluid surrounding the device, causing well fluid to flow through the filters 3 and 4 with fluid in the top-up chamber 19 flowing via the check valve 17 into the reservoir 18.

The applied pressure in the well fluid is then released rapidly. Fluid in the first chamber 19 can exhaust freely back through the filters 3 and 4, but fluid in the reservoir 18 cannot return through the check valve 17 and can only return through the flow restrictor 15 at a very slow rate. There is therefore a transient positive pressure differential between the reservoir 18 and the exterior well fluid surrounding the device which acts on the cross-sectional area of the end of the piston 14.

When a sequence of applying and releasing well fluid pressure is carried out, the piston 14 will initially shear the shear pins 16 and then be intermittently driven out of the reservoir 18 with each pressure cycle. The force that can be generated is a function of the applied pressure and the cross-sectional area chosen for the moveable piston 14.

Figure 3:
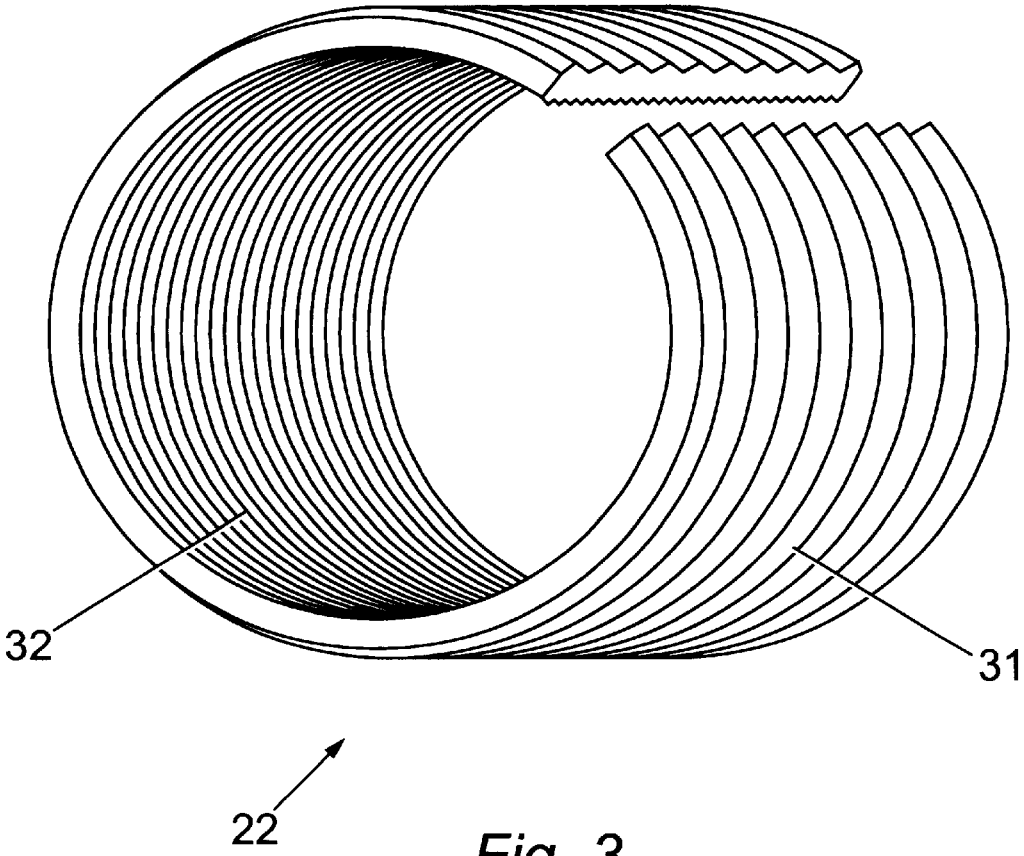
FIG. 3 is a perspective view of a C-ring used in the device of FIG. 2.

The piston 14 is prevented from return motion by the C-ring 22 which is shown in greater detail in FIG. 3. The C-ring 22 is in the form of a split cylinder having circumferential teeth on its inner 32 and outer 31 surfaces. Instead of being truly circumferential, it may be convenient to provide the teeth 31 and 32 by conventional screw thread cutting. The outer teeth 31 may suitably be of about 8 threads per inch and the inner teeth 32 of a much finer pitch. Matching formations are machined on the facing surfaces of the piston 14 and the outer mandrel 5. The C-ring 22 may be dimensioned to have a degree of inward resilience, such that it is a close fit on the piston 14 and a looser fit on the outer mandrel 5. This arrangement works a one way motion or ratchet means.

FIGS. 4(*a*), (*b*) and (*c*) show a modified embodiment which is generally similar to that of FIGS. 2(*a*) to (*e*) and in which like parts are denoted by like reference numerals. In this embodiment, however, the actuating device is physically separate from the tool to be set and hydraulic pressure is communicated from the reservoir 18 via a conduit 40 to an annular piston 14*a* within a separate annular chamber.

These embodiments have a number of advantages. The elastomeric seals are subject only to a limited differential pressure for a short period of time, and are not subject to absolute pressure as no atmospheric chamber is required. In any event the seals are not crucial to the integrity of the well after completion. Therefore, once the setting sequence is completed, the seals become redundant. Further, as the embodiments operate by using a differential pressure and do not require an atmospheric chamber, there is no setting depth limitation. The control of the device is simple. The setting sequence can be repeated any desired number of times. Also, the device allows testing of the completion annulus before setting the tool, by increasing the pressure in the completion annulus to check for leaks.

If it is decided to abort the setting sequence, then slowly bleeding off the pressure in the completion annulus will avoid setting the tool. For instance, if the differential pressure required to break the shear pins 16 is 1500 p.s.i., then if the pressure in the annulus is reduced slowly in stages of 500 p.s.i., the fluid contained in the reservoir 18 will leak through the flow restriction 15, thereby maintaining the shear pins 16 in tact.

Modifications and improvements may be made to the foregoing embodiments within the scope of the present invention.

What is claimed is:

1. A downhole pressure activated device comprises a chamber having a fluid port for communication between the chamber and downhole fluid located outwith the device, the fluid port comprising a fluid flow control mechanism which permits fluid flow into the chamber and substantially prevents reverse flow, and the chamber being provided with a pressure transmission means by which a pressure in the chamber greater than that in the downhole fluid is capable of being applied to a tool to be operated by the device, wherein the chamber is a second chamber, and the device further comprises a first chamber, the first and second chambers being interconnected by the fluid port, and the first chamber having a fluid inlet which, in use, is open to the downhole fluid located outwith the device.

2. A downhole pressure activated device according to claim 1, wherein the fluid flow control mechanism comprises a check valve and a fluid flow restrictor arranged in parallel, the check valve permitting fluid flow into the chamber and substantially preventing reverse flow.

3. A downhole pressure activated device according to claim 1, wherein the pressure transmission means is a piston, which is in fluid communication with the second chamber, and which is capable of applying a mechanical force to the tool.

4. A downhole pressure activated device according to claim 3, wherein the piston is provided with means permitting motion of the piston in a tool setting direction and substantially preventing reverse motion.

5. A downhole pressure activated device according to claim 1, wherein the pressure transmission means is a fluid outlet provided for the second chamber and which is capable of transmitting pressure of fluid located in the second chamber to the tool.

6. A downhole pressure activated device according to claim 1, wherein the device comprises an inner mandrel for connection in a borehole string, and an outer mandrel, the annular space between the inner and outer mandrels being divided by a seal ring to define said first and second chambers.

7. A downhole pressure activated device according to claim 6, wherein the piston is a cylindrical member slidable between the inner and outer mandrels at one end of the device, and said fluid inlet being provided at the opposite end of the device and including filter means.

8. A downhole pressure activated device according to claim 6, wherein the check valve is located within the seal ring and communicates with the first chamber via an inlet tube.

9. A downhole pressure activated device according to claim 6, wherein the fluid flow, control mechanism comprises a check valve and a fluid flow restrictor arranged in parallel, the check valve permitting fluid flow into the chamber and substantially preventing reverse flow, wherein the fluid flow restrictor is located within the seal ring and communicates with the first chamber.

10. A downhole pressure activated device according to claim 4, wherein the device comprises an inner mandrel for connection in a borehole string, and an outer mandrel, the annular space between the inner and outer mandrels being divided by a seal ring to define said first and second chambers, wherein the means permitting motion of the piston in a tool setting direction is a C-shaped annular member interposed between the piston and the outer mandrel, the C-shaped member being provided on its opposite faces with formations which engage in substantially matching formations in the piston and the outer mandrel.

11. A downhole pressure activated device according to claim 3, wherein the device comprises an inner mandrel for connection in a borehole string, and an outer mandrel, the annular space between the inner and outer mandrels being divided by a seal ring to define said first and second chambers, and wherein the piston is initially locked to the outer mandrel by a destructible locking mechanism which is adapted to yield under a given applied load.

12. A method of operating a tool downhole by applying pressure, the method comprising the steps of:

including in a string for insertion into a borehole a pressure activated device comprising a fluid chamber which communicates with downhole fluid located outwith the device in the borehole in a manner that allows substantially uninhibited flow of fluid into the chamber but substantially restricts flow of fluid out of the chamber, a pressure transmission means in fluid communication with the chamber and the pressure transmission means being connected to the tool operated by applying pressure;

inserting the string into the borehole;

increasing the pressure of fluid within the borehole so that a portion of the fluid flows from the borehole into the chamber;

reducing the pressure of the fluid in the borehole to generate a pressure differential between the fluid in the borehole and the fluid in the chamber; whereby the pressure differential acts upon the pressure transmission means to operate the tool by applying pressure, wherein the chamber is a second chamber, and the device further comprises a first chamber, the first and second chambers being interconnected by the fluid port, and the first chamber having a fluid inlet which, in use, is open to the downhole fluid located outwith the device.

13. A method according to claim 12, wherein the fluid chamber communicates with the downhole fluid located outwith the device in the borehole via a check valve and a fluid flow restrictor arranged in parallel, the check valve permitting fluid flow into the chamber and substantially preventing reverse flow.

14. A method according to claim 12, wherein the pressure transmission means is a piston, which is in fluid communication with the second chamber, and which causes a mechanical force to be applied to the tool.

15. A method according to claim 14, wherein the piston is provided with means permitting motion of the piston in a tool setting direction and substantially preventing reverse motion.

16. A method according to claim 12, wherein the pressure transmission means is a fluid outlet provided for the second chamber and which transmits pressure of fluid located in the second chamber to the tool.

17. A method according to claim 12, wherein the pressure activated device is included in a completion string.

18. A downhole pressure activated device comprises a chamber filled with a compressible liquid, the chamber having a fluid port for communication between the chamber and downhole fluid located outwith the device, the fluid port comprising a fluid flow control mechanism which permits fluid flow into the chamber during application of pressure in the downhole fluid located outwith the device, the fluid flow control mechanism further substantially preventing reverse flow, and a pressure transmission means which is in fluid communication with the compressible liquid in the chamber, such that following application of an initial pressure in the downhole fluid located outwith the device and further following reduction of the initial pressure in the downhole fluid located outwith the device, the compressible fluid within the chamber stores the initial pressure, and the stored initial pressure acts upon the pressure transmission means which is capable of applying the stored initial pressure to a tool to be operated by the device, the pressure transmission means only being capable of applying the initial pressure to the tool after the application of the initial pressure outwith the device has been reduced.

19. A downhole pressure activated device according to claim 18, wherein the fluid flow control mechanism comprises a check valve and a fluid flow restrictor arranged in parallel, the check valve permitting fluid flow into the chamber and substantially preventing reverse flow.

20. A downhole pressure activated device according to claim 18, wherein the chamber is a second chamber, and the device further comprises a first chamber, the first and second chambers being interconnected by the fluid port, and the first chamber having a fluid inlet which, in use, is open to the downhole fluid located outwith the device.

21. A downhole pressure activated device according to claim 20, wherein the pressure transmission means is a piston, which is in fluid communication with the second chamber, and which is capable of applying a mechanical force to the tool.

22. A downhole pressure activated device according to claim 21, wherein the piston is provided with means permitting motion of the piston in a tool setting direction and substantially preventing reverse motion.

23. A downhole pressure activated device according to claim 20, wherein the pressure transmission means is a fluid outlet provided for the second chamber and which is capable of transmitting pressure of fluid located in the second chamber to the tool.

24. A downhole pressure activated device according to claim 20, wherein the device comprises an inner mandrel for connection in a borehole string, and an outer mandrel, the annular space between the inner and outer mandrels being divided by a seal ring to define said first and second chambers.

25. A downhole pressure activated device according to claim 24, wherein the pressure transmission means is a piston, which is in fluid communication with the second chamber, and which is capable of applying a mechanical force to the tool, and the piston is a cylindrical member slidable between the inner and outer mandrels at one end of the device, and said fluid inlet being provided at the opposite end of the device and including filter means.

26. A downhole pressure activated device according to claim 24, wherein the fluid flow control mechanism comprises a check valve and a fluid flow restrictor arranged in parallel, the check valve permitting fluid flow into the second chamber and substantially preventing reverse flow, and the check valve is located within the seal ring and communicates with the first chamber via an inlet tube.

27. A downhole pressure activated device according to claim 24, wherein the fluid flow control mechanism comprises a check valve and a fluid flow restrictor arranged in parallel, the check valve permitting fluid flow into the chamber and substantially preventing reverse flow, wherein the fluid flow restrictor is located within the seal ring and communicates with the first chamber.

28. A downhole pressure activated device according to claim 22, wherein the device comprises an inner mandrel for connection in a borehole string, and an outer mandrel, the annular space between the inner and outer mandrels being divided by a seal ring to define said first and second chambers, wherein the means permitting motion of the piston in a tool setting direction is a C-shaped annular member interposed between the piston and the outer mandrel, the C-shaped member being provided on its opposite faces with formations which engage in substantially matching formations in the piston and the outer mandrel.

29. A downhole pressure activated device according to claim 21, wherein the device comprises an inner mandrel for connection in a borehole string, and an outer mandrel, the annular space between the inner and outer mandrels being divided by a seal ring to define said first and second chambers, and wherein the piston is initially locked to the outer mandrel by a destructible locking mechanism which is adapted to yield under a given applied load.

30. A method of operating a tool downhole by applying pressure, the method comprising the steps of:

including in a string for insertion into a borehole a pressure activated device comprising a fluid chamber filled with compressible liquid which communicates with downhole fluid located outwith the device in the borehole in a manner that allows substantially uninhibited flow of fluid into the chamber but substantially restricts flow of fluid out of the chamber, a pressure transmission means in fluid communication with the chamber and the pressure transmission means being connected to the tool operated by applying pressure;

inserting the string into the borehole;

increasing the pressure of fluid within the borehole so that a portion of the fluid flows from the borehole into the chamber;

reducing the pressure of the fluid in the borehole to generate a pressure differential between the fluid in the borehole and the fluid in the chamber; whereby the pressure differential acts upon the pressure transmission means to operate the tool by applying pressure, where the pressure transmission means is only capable of applying the pressure to the tool during the presence of the pressure differential.

* * * * *